US005651608A

United States Patent [19]

Wedell

[11] Patent Number: 5,651,608

[45] Date of Patent: Jul. 29, 1997

[54] ASSEMBLY METHOD FOR SEALED LIGHT FIXTURE

[75] Inventor: Mark T. Wedell, Germantown, Tenn.

[73] Assignee: Thomas & Betts Corporation, Memphis, Tenn.

[21] Appl. No.: 235,605

[22] Filed: Apr. 29, 1994

[51] Int. Cl.[6] ..... F21V 31/02

[52] U.S. Cl. ..... 362/267; 362/375; 362/310; 362/294

[58] Field of Search ..... 362/310, 311, 362/306, 307, 267, 158, 373, 226, 374, 375, 475, 294; 524/188, 730, 785, 788, 860

[56] References Cited

U.S. PATENT DOCUMENTS

| | | | |
|---|---|---|---|
| 3,725,714 | 4/1973 | Anderson | 313/110 |
| 3,751,657 | 8/1973 | Sangiamo et al. | 240/41.35 E |
| 3,832,540 | 8/1974 | Roth | 240/51.11 R |
| 4,240,131 | 12/1980 | Albrecht | 362/267 |
| 4,315,302 | 2/1982 | Petralia | 362/226 |
| 4,410,931 | 10/1983 | Decandia et al. | 362/267 |
| 4,414,613 | 11/1983 | Mayer | 362/267 |
| 4,433,366 | 2/1984 | Wade | 362/375 X |
| 4,509,106 | 4/1985 | Mayer et al. | 362/375 X |
| 4,520,432 | 5/1985 | Mayer | 362/267 |
| 4,574,337 | 3/1986 | Poppenheimer | 362/267 |
| 4,658,179 | 4/1987 | Roberts | 313/113 |
| 4,683,523 | 7/1987 | Olsson et al. | 362/267 |
| 4,735,979 | 4/1988 | Beers et al. | 524/188 |
| 4,755,711 | 7/1988 | Fields et al. | 313/111 |
| 4,841,419 | 6/1989 | Ohishi | 362/226 X |
| 4,950,348 | 8/1990 | Larson | 156/275.3 |
| 4,996,635 | 2/1991 | Olsson et al. | 362/267 |
| 5,010,455 | 4/1991 | Luallin et al. | 362/61 |
| 5,072,348 | 12/1991 | Tsukada | 362/226 |
| 5,113,331 | 5/1992 | Nagengast | 362/267 |
| 5,243,507 | 9/1993 | Atkins et al. | 362/376 |
| 5,276,583 | 1/1994 | Tyson | 362/267 X |
| 5,285,357 | 2/1994 | Makita | 362/61 X |

*Primary Examiner*—Denise L. Gromada
*Assistant Examiner*—Thomas M. Sember
*Attorney, Agent, or Firm*—Salvatore J. Abbruzzese

[57] ABSTRACT

A quartz halogen outdoor floodlight assembly, having an improved lamp, reflector, and housing therefor for increased adjustability and overall performance. The housing comprises a two component unit, having upper and lower separable housing members, interconnected through a quarter turn fastening system comprising at least one key extending from the lower housing member, a receiving keyway formed in the upper housing member, and a camming ramp formed internally in the upper housing member. A lens in secured to the face of the upper housing member by a sealing adhesive, which simultaneously retains a reflector within the upper housing. A lamp operatively secured within a socket disposed in the lower housing member is operatively positioned in the reflector upon assembly. The lamp preferably includes an internal reflector which aligns with the external reflector to increase longitudinal light output.

10 Claims, 3 Drawing Sheets

ASSEMBLY METHOD FOR SEALED LIGHT FIXTURE

FIELD OF THE INVENTION

The present invention relates to lighting fixture assembly methods and, more particularly, to a method of assembling a sealed, two-piece housing for a quartz halogen light fixture.

BACKGROUND OF THE INVENTION

Outdoor flood lights are commonly used in both residential and commercial settings for increased security and improved appearance. For years, most outdoor flood lights have utilized large incandescent bulbs, which perform acceptably well under most circumstances. In a typical conventional fixture, two such bulbs, commonly referred to in the industry as "PAR 38" lamps, are provided on a single base, with each bulb being retained by a socket secured to the base through a hinged connector providing multiple degrees of adjustability.

In more recent years, quartz halogen lamps have become increasingly popular for use in outdoor flood lights, due to their attractive appearance, increased light generation, superior efficiency (measured in lumens/watt), and longer life. Quartz halogen flood light assemblies typically comprise a single fixture adjustably mounted on a base, utilizing a dual-end lamp horizontally mounted within a rectangular housing, as shown, for example, in U.S. Pat. Nos. 4,410,931 issued Oct. 18, 1983 to De Canalia et al., and 3,832,540 issued Aug. 27, 1974 to Roth.

It has been discovered that conventional quartz halogen fixtures have at least two significant drawbacks. First, due to the relatively large size of the housing required for a dual-end lamp, it is not feasible to include two housings in a single assembly for most applications. Therefore, the area to be lighted by a single assembly is significantly reduced. Second, dual-end lamps must be maintained in a substantially horizontal position in order to avoid a significant reduction in life span. Accordingly, a conventional quartz halogen fixture is severely limited in its degrees of adjustability. These disadvantages, particularly when combined, may severely reduce the feasibility of quartz halogen flood lights for many users and in many applications.

Conventional quartz halogen flood light fixtures comprise a single component housing, having a removable lens secured to its face. Replacement of the lamp typically requires removal of the lens by disengaging a plurality of clamps or latches disposed around its perimeter. It has also been recognized that such fixtures are comparatively expensive, due to their size and number of components. Furthermore, lamp replacement typically requires an inordinate number of steps for removal and replacement of the lens.

Single-end quartz halogen lamps are produced in a variety of configurations, some with an internal, laterally oriented reflector such as that shown in U.S. Pat. No. 3,555,338 to Scoledge et al., issued Jan. 12, 1971. Others, such as that shown in U.S. Pat. No. 4,280,076 to Walsh issued Jul. 21, 1981, disclose a longitudinally oriented reflector whose primary purpose is to increase efficiency by reflecting infrared energy back to the filament. Neither of these devices discloses the use of an internal, longitudinally oriented reflector secured to the filament for use in increasing light projection in the longitudinal direction, particularly in cooperation with an external reflector.

SUMMARY OF THE INVENTION

An object of the present invention is to provide an improved method of assembling a sealed light fixture housing.

Another object is to provide an improved method of sealingly assembling a lens to a light fixture housing.

A further object is to provide an improved method of sealingly assembling the two portions of a two-piece housing for a light fixture.

A still further object is to provide an improved method for assembling a fixture housing for a quartz halogen light fixture.

In order to achieve these and other objects, the present invention comprises a quartz halogen flood light assembly having a pair of light fixtures secured to multi-adjustable mounting arms attached to a single base. Each housing contains a single ended quartz halogen lamp having an internal reflector for improved performance. Each fixture is uniquely divided into first and second separable housing components, interconnected through a built-in, automatically sealing quarter turn fastening system.

In the preferred embodiment disclosed herein, a lens is permanently affixed to the outer housing member by a novel method which simultaneously retains a reflector within the housing. According to the method of this invention, the reflector is placed in a position with its outer, annular flange disposed adjacent a channel formed in the face of the housing, a quantity of sealing adhesive is placed in the channel, and the lens is pressed thereon. Upon curing, the adhesive seals the housing member and retains the lens and reflector in their operative positions.

Upon assembly of the first and second housing components, the internal lens reflector is substantially aligned with the external reflector to maximize light output, and minimize the amount of light directed into the bottom of the housing. The external reflector has a downwardly protruding lip which surrounds the lower portion of the lamp to further reduce the transmission of light into the housing.

The above stated and other objects will become apparent to those skilled in the art upon reading the following detailed description in conjunction with the appended drawings.

DETAILED DESCRIPTION OF THE PREFERRED EMBODIMENT

Figure 1:
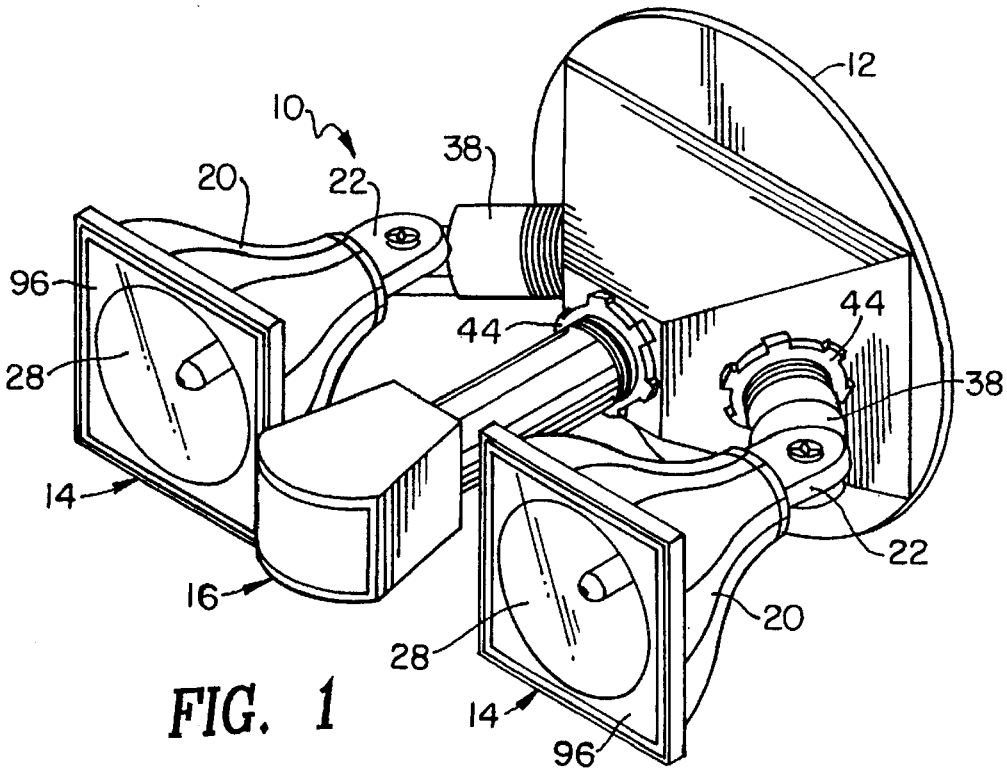
FIG. 1 is a top, side perspective view of the lighting fixture of the present invention.
Figure 2:
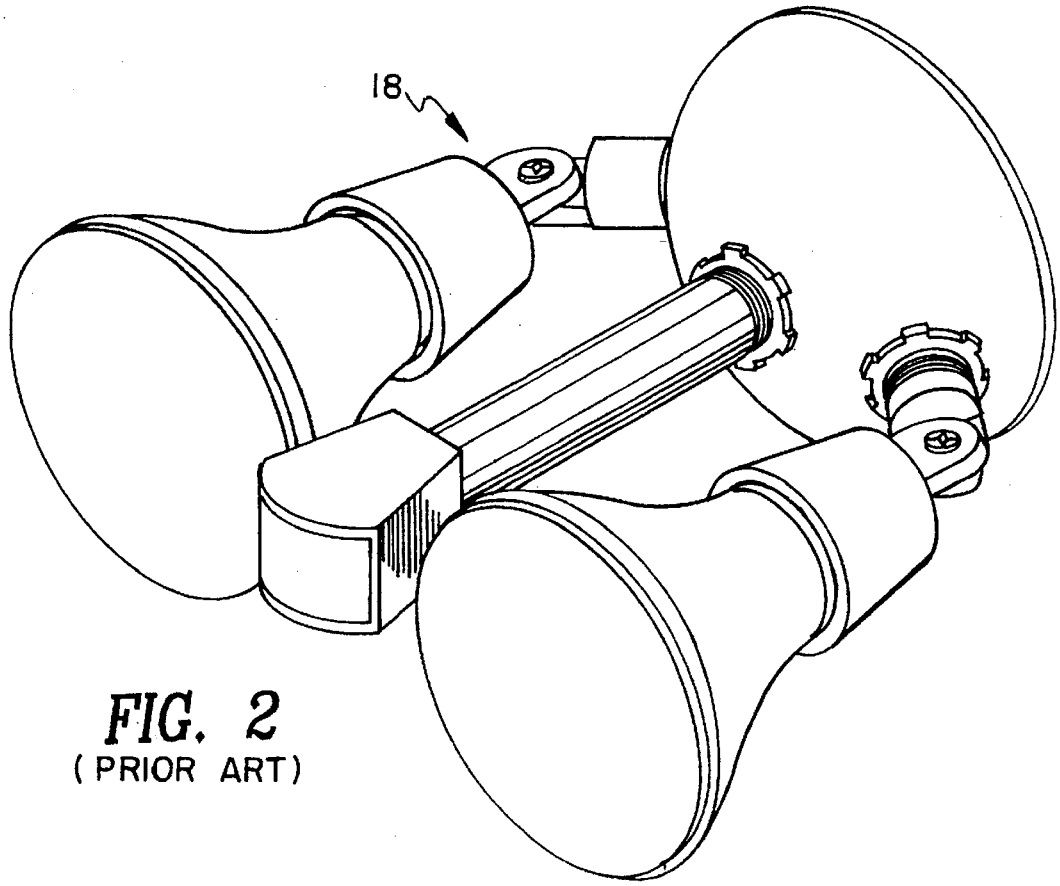
FIG. 2 (PRIOR ART)
FIG. 2 is a top, side perspective view of a conventional, prior art flood light assembly.

Referring initially to FIG. 1, outdoor lighting assembly 10 is shown comprising a base plate 12 and a pair of identical lighting fixtures 14. The preferred embodiment of assembly 10 also includes a conventional motion sensor 16, the operation of which is well known to those skilled in the art and, therefore, need not be disclosed herein. Assembly 10 is configured to be a direct replacement for a conventional PAR 38 assembly 18, as shown in FIG. 2, the operation and structure of which are well known to those skilled in the art. The various unique features contained in assembly 10 are described hereinbelow.

Figure 3:
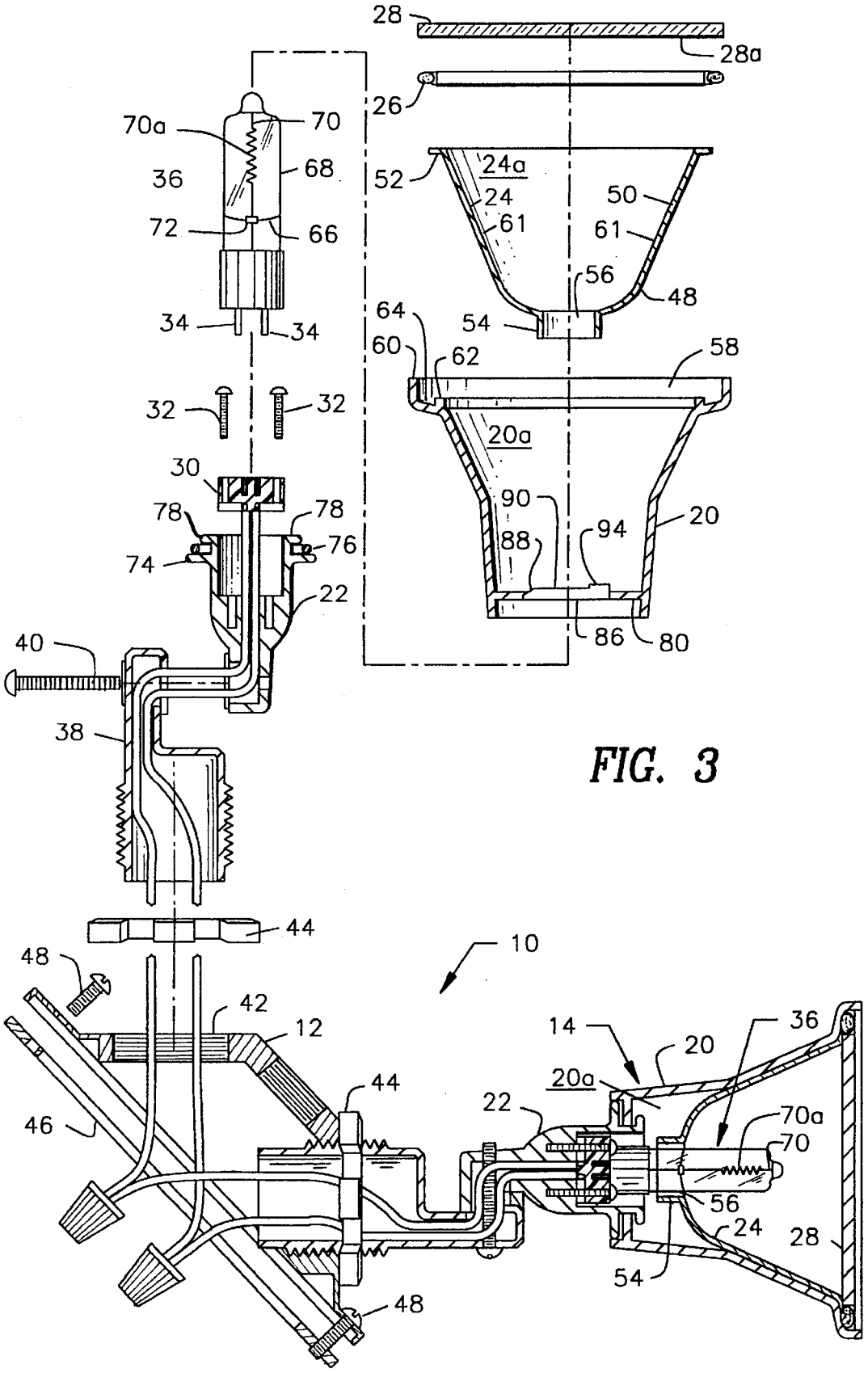
FIG. 3 is a side, sectional view, partially exploded, of the lighting assembly shown in FIG. 1, on an enlarged scale.

With reference now also to FIG. 3, each fixture 14 is shown comprising an upper housing 20 removably securable to lower housing 22. The upper housing 20 and the lower housing 22 are each preferably formed of die-cast zinc or aluminum because of their desirably high thermal conductivity properties. The lower housing 22 is also preferably formed to be of substantial mass with relatively thick walls to serve as an effective heat sink. The lower housing 22 is further recessed under the upper housing 20 and the reflector 24 to minimize the impact of radiant energy and overhealing thereof.

When assembled in a manner described below, upper housing 20 contains reflector 24, retained by adhesive material 26, and lens 28. Lens 28 is preferably formed of tempered glass and is generally of planar configuration. Lower housing 22 contains a receptacle 30 secured in place by screws 32, suitable for engaging electrodes 34 extending from the proximate end of lamp 36. The base end of lower housing 22 is hingedly secured to adjustment arm 38 in a conventional manner by screw 40, with arm 38 being adjustably retained within threaded hole 42 in base plate 12, and secured by lock nut 44. Base plate 12 is configured for attachment to structure 46, such as the exterior wall of a building, by screws 48. As with conventional assembly 18, each fixture 14 may be rotated and angularly adjusted as desired upon selective manipulation of adjustment arm 38, screw 40, and lock nut 44.

As best seen in FIG. 3, reflector 24 is essentially cup-shaped, having a curved lower portion 48 and a frusto-conical upper portion 50 defining a cavity **28*a* therewithin. Reflector 24 is open at both its top and bottom ends, with an annular flange 52 extending from the perimeter of upper portion 50, and annular lip 54 extending longitudinally downwardly from the opening 56 in lower portion 48, the function of lip 54 being described below. Reflector 24 is preferably formed from drawn aluminum. The curved lower portion 48** is preferably dish-shaped, having a generally parabolic cross-section.

Figure 4:
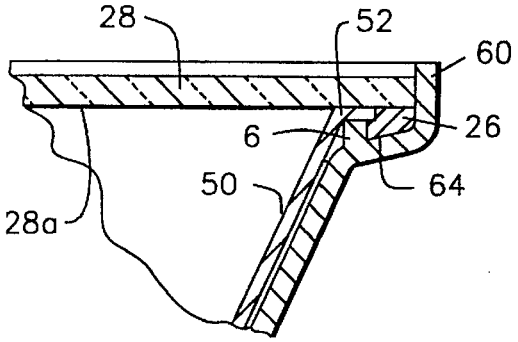
FIG. 4 is an enlarged sectional view detailing the attachment of the lens and reflector to the outer housing.
Figure 6:
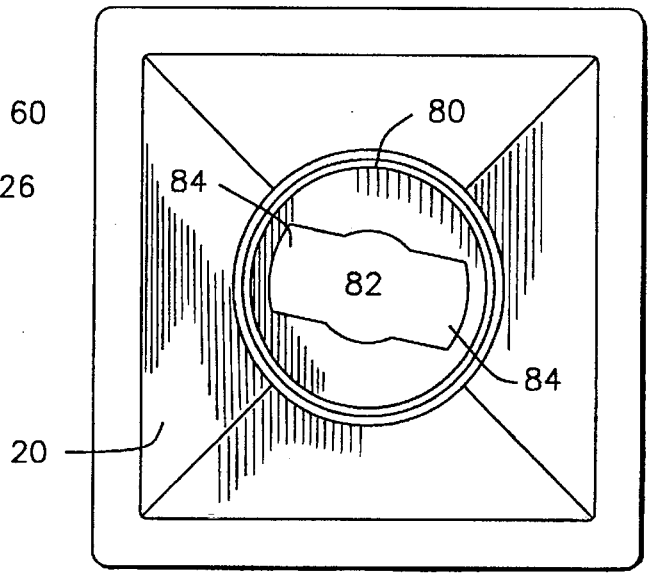
FIG. 6 is a bottom plan view of the upper housing member.

The open face 58 of upper housing 20 is bounded by an upstanding peripheral wall 60, integrally formed with side walls 61. Ridge 62 is formed inwardly from wall 60, and parallel thereto, thereby forming a channel 64 around the periphery of base 58. A unique assembly method has been devised for securing lens 28 to upper housing 20, wherein a suitable quantity of fluid, uncured adhesive material 26 is placed within channel 64, reflector 24 then placed in position with flange 52 supported by ridge 62, and lens 28 pressed into position within wall 60. As best seen in FIG. 4, adhesive material 26 effectively fills channel 64 and adheres the inner surface **28*a* of lens 28 to upper housing 20, with flange 52 sandwiched between lens 28 and ridge 62, thereby securing reflector 24. The inner surface 28*a* compresses the adhesive material 26 into the channel 64 and against the reflector flange 52. Upon curing of adhesive material 26, lens 28 and reflector 24 are operatively secured to upper housing 20, and a waterproof seal is simultaneously formed around face 58. Adhesive material 26** is preferably a silicone rubber compound, but may be any suitable compound adapted for the purpose.

Face 58 and lens 28 are preferably square, as shown herein. It is to be understood, however, that face 58 and lens 28 may be round, hexagonal, or of virtually any feasible configuration without departing from the scope of this invention.

Lamp 36 includes an internal reflector 66 operatively mounted within tubular quartz envelope 68. Filament 70 includes a coiled section **70*a* and is electrically connected to electrodes 34 in a conventional manner. Filament 70 extends longitudinally within envelope 68, passing through insulator 72 which prevents electrical contact between filament 70 and reflector 66. In the preferred embodiment shown, reflector 66 has an upwardly curved surface which generally conforms to the contour of lower curved portion 48 of reflector 24. When assembled as shown, reflector 66 substantially fills in the gap in reflector 24 caused by opening 56, thereby increasing the projection of light longitudinally outwardly through the envelope 68 toward the distal end of lamp 36. Reflector 66 may be formed from polished tungsten or any other material suitable for the purpose. Insulator 72 is preferably formed from glass or ceramic, and serves to secure reflector 66 in its operative position circumscribing a portion of filament 70. Aside from the inclusion of reflector 66 and insulator 72, lamp 36** is otherwise a conventional single-ended quartz halogen lamp, but requires no additional labor or time in assembly.

Figure 5:
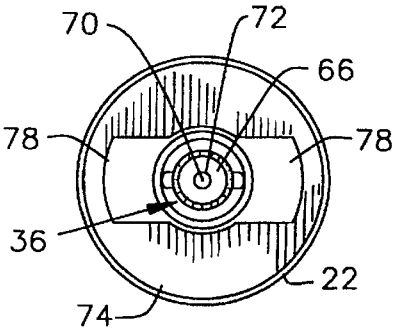
FIG. 5 is a top plan view of the lower housing member, with the lamp in place.
Figure 7:
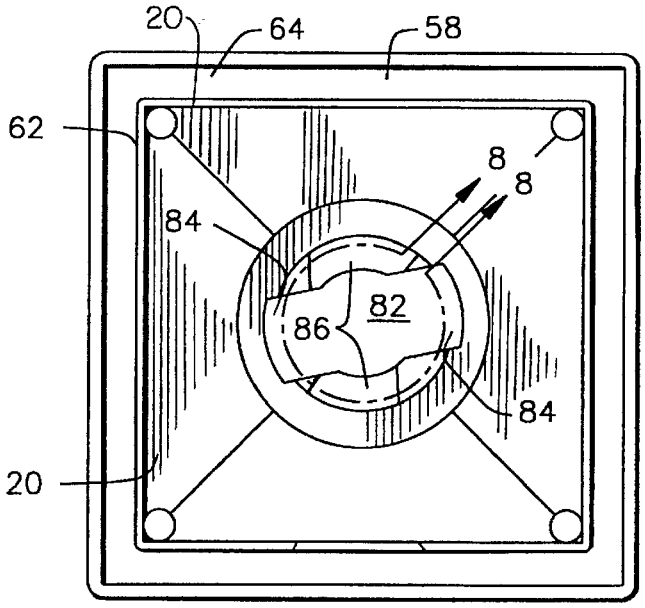
FIG. 7 is a top plan view of the upper housing member.
Figure 8:
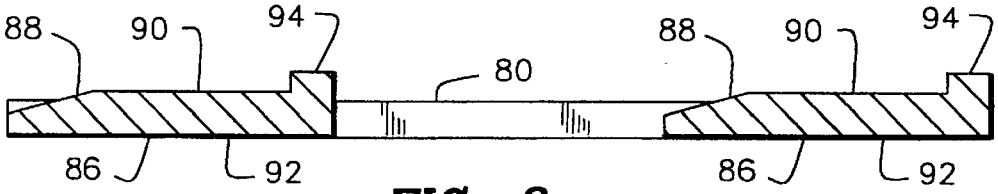
FIG. 8 is an enlarged sectional view taken along line 8—8 of FIG. 7.

Upper housing 20 and lower housing 22 are removably interconnected through a unique quarter turn fastening system. Referring now to FIGS. 3 and 5, lower housing 22 has an integrally formed annular shoulder 74 extending radially from the top, connecting end. Disposed on the top surface of shoulder 74 is seal 76. A pair of keys 78, spread 180° apart, project radially outwardly from the distal end of lower housing 22. The proximate end 80 of upper housing 20 has an opening 82 formed therein, defining a pair of keyways 84 configured to receive keys 78. As seen in FIGS. 7 and 8, the inside surface of proximate end 80 has a pair of camming ramps 86 formed thereon, spaced 180° apart and disposed annularly about opening 82 and intermediate keyways 84. Each ramp 86 includes a leading edge 88 having an inclined upper surface formed thereon, a generally flat intermediate section 90 having a substantially horizontal upper surface formed thereon, and a trailing edge 92 having a stop 94 projecting upwardly therefrom.

Assembly of upper housing 20 onto lower housing 22 is accomplished by inserting lamp 36 into opening 82 with keys 72 aligned with keyways 84, until proximate end 80 contacts seal 76. Slight additional longitudinal pressure causes proximate end 80 to resiliently compress seal 76, whereupon keys 78 are positioned within upper housing 20. The rotation of upper housing 20 (clockwise, in the preferred embodiment) slidably engages the top surfaces of camming ramps 86 with the underside surfaces of keys 78, with the rotation being limited upon keys 78 abutting stops 94. The inclined upper surfaces of leading edges 80 axially draw together upper housing 20 and lower housing 22 and facilitate the engagement of ramps 86 with keys 78 while the forces generated between intermediate portion 90 and keys 78 adequately compresses the seal 78 to form a substantially watertight junction between upper housing 20 and lower housing 22. Removal of upper housing 20 is accomplished simply by reversing the quarter-turn rotation. The relative ease of assembly and disassembly of fixture 14 greatly simplifies the replacement of lamp 36 as compared to conventional quartz halogen floodlight fixtures.

In the preferred embodiment shown, lower housing 22 includes two keys 78, and upper housing 22 includes a like number of keyways 84 and camming ramps 86. It will be readily apparent to those skilled in the art, however, that it may be possible to obtain acceptable results with a different number of keys, keyways, and camming ramps. When constructed as shown, upper housing 20 is installed and removed by rotation through an angle of 90°, i.e., a quarter turn. Obviously, this would be affected by the number of keys, keyways, and camming ramps employed.

In the preferred embodiment of this invention, the disposition of seal 76 onto the upper surface of shoulder 74 is accomplished in a novel manner. A suitable composition of adhesive material is deposited onto shoulder 74 and allowed to cure until the exposed surface is no longer tacky or adhesive while the underside adheres to shoulder 74. Upper housing 20 may then be secured to lower housing 22 as described above. The same compound for seal 76 is preferably also used for adhesive 26, thus increasing the manufacturing efficiencies over the known prior art. In the preferred arrangement the composition for seal 76 comprises silicone rubber, suitably impregnated with nitrogen bubbles in a conventional manner, to allow the cured material to be foamed for resilient compression and re-use.

As seen in FIG. 1, the corners 96 of lens 28 are preferably shaded, leaving only a clear circular region corresponding to the opening in reflector 24 bounded by flange 52. It has been found that tempered soda lime glass is preferable for forming lens 28, while the shading in corners 96 comprises black ceramic fired ink applied to inner surface 28*a* of lens 28 by a conventional process. It is fully expected, however, that the composition and appearance of lens 28 may be altered as desired without departing from the spirit and scope of this invention.

As mentioned above, opening 56 in lower portion 48 of reflector 24 includes a longitudinally downwardly extending lip 54, as illustrated in FIG. 3. Upon assembly of reflector 24 within cavity 20*a* of upper housing 20, opening 56 defined by annular lip 54 is substantially aligned with opening 82 so that lamp 36 may be received and properly positioned within reflector 24. Lip 54 circumscribes a portion of lamp 36, preferably the exposed portion of envelope 68 beneath reflector 66. Lip 54 therefore restricts the passage of light emanating from filament 70 into cavity 20*a* of upper housing 20, and further assists reflectors 24 and 66 in projecting the maximum amount of light outwardly in the desired direction.

The lip 54 also prevents light from heating the components disposed beneath the reflector 24 by radiation from the filament 70. Accordingly, fixture 14 is capable of operating at a lower overall housing temperature than conventional quartz halogen floodlight fixtures. Fixture 14 also projects a beam spread of approximately 120°, which is substantially greater than the 55°–60° beam spread provided by conventional PAR 38 fixtures. By combining a single ended quartz halogen lamp 36 with the uniquely formed reflector 24, fixture 14 is capable of providing superior light projection and dispersion, a longer life, and lower energy consumption than a conventional PAR 38 fixture. Further, the opening 56 in the reflector 24 does not have a sharp inner edge resulting from burrs during manufacturing as the projecting annular lip 54 allows for any such sharp edges to occur on the bottom, outside edge of the lip 54. Thus, scratching of the lamp envelope during assembly is prevented.

While the principles of an improved two-piece quartz halogen flood light assembly have been made clear from the foregoing detailed description, it is to be understood that the scope of coverage provided by this patent is to be limited only by the following claims, and not by the specific embodiment described herein. It is also to be understood that references herein to "top", "upper", "lower", and "side" structures are intended solely for purposes of providing an enabling_disclosure, and in no way suggest limitations regarding the operative orientation of assembly 10 or any components thereof.

What is claimed is:

1. A method of assembling a sealed lighting fixture comprising a housing, a reflector having a peripheral flange and a lens, said method comprising the steps of:

providing a housing including side walls and an open face bounded by an upstanding peripheral wall integrally formed with the side walls and a ridge positioned inwardly from the wall, thereby forming a channel around the periphery of said open face;

placing said reflector within said housing with said flange supported by the housing ridge and extending into said housing channel;

depositing a fluid, uncured quantity of sealing adhesive within said channel and in contact with said reflector flange;

positioning said lens within said open end of said housing with a peripheral edge of said lens seated within said channel and compressing said sealing adhesive;

allowing said sealing adhesive to cure, thereby fixedly securing said lens to said housing with said flange of said reflector sandwiched therebetween.

2. A method according to claim 1, wherein said lens is formed of tempered glass.

3. A method according to claim 2, wherein said lens is substantially planar wherein said inner surface is substantially flat.

4. A method according to claim 1, wherein:

said sealing adhesive comprises a silicone rubber compound.

5. A method according to claim 1, wherein:

said sealing adhesive comprises a silicone rubber compound foamed with nitrogen bubbles.

6. A method according to claim 1, further comprising the steps of:

providing a lower housing having substantial mass with relatively thick walls thereby providing an effective heat sink, said lower housing being adapted to receive a receptacle for accepting a lamp;

coupling said upper and lower housing to form a sealed lighting fixture.

7. A method according to claim 1, wherein the housing is formed by die-casting one of zinc and aluminum.

8. A method of assembling a sealed lighting fixture comprising first and second housing members, said first housing member having a plurality of keyways formed in a surface thereof and said second housing member having a plurality of keys projecting therefrom insertable through said keyways and securable within said first housing member, said second housing member also having an annular shoulder formed beneath said keys, said shoulder having a top surface, said method comprising the steps of:

applying a fluid, uncured quantity of sealing adhesive to said top surface of said annular shoulder;

allowing said sealing adhesive to cure, thereby forming a non-adhesive sealing member having one surface adhered to said shoulder and a non-adhesive exposed surface;

inserting said keys into said keyways and against said exposed surface so that said sealing member is compressed between said shoulder and said surface of said first housing member; and securing said keys within said first housing member, thereby interconnecting said first and second housing members with said sealing member resiliently disposed therebetween.

9. A method according to claim 8, wherein:

said sealing adhesive comprises a silicone rubber compound.

10. A method according to claim 8, wherein:

said sealing adhesive comprises a silicone rubber compound foamed with nitrogen bubbles.

* * * * *